US007362220B2

(12) United States Patent
Chapman, Jr. et al.

(10) Patent No.: US 7,362,220 B2
(45) Date of Patent: Apr. 22, 2008

(54) SYSTEM AND METHOD FOR PROVIDING CONTROLLED ILLUMINATION DURING DETECTED HAZARDOUS CONDITIONS

(75) Inventors: John Gilman Chapman, Jr., Delaware, OH (US); Nicholas Ashworth, Dublin, OH (US); Robert Burt, Columbus, OH (US); Timothy E. Wallaert, New Hudson, MI (US)

(73) Assignee: Robertshaw Controls Company, Carol Stream, IL (US)

( * ) Notice: Subject to any disclaimer, the term of this patent is extended or adjusted under 35 U.S.C. 154(b) by 2 days.

(21) Appl. No.: 11/031,574

(22) Filed: Jan. 6, 2005

(65) Prior Publication Data

US 2005/0151637 A1 Jul. 14, 2005

Related U.S. Application Data

(60) Provisional application No. 60/535,424, filed on Jan. 8, 2004.

(51) Int. Cl.
*G08B 29/00* (2006.01)

(52) U.S. Cl. ..... 340/506; 340/332

(58) Field of Classification Search ..... 340/506, 340/331, 332, 691.6, 691.2, 627, 628, 629, 340/630

See application file for complete search history.

(56) References Cited

U.S. PATENT DOCUMENTS 4,074,225 A * 2/1978 Vandeweghe ..... 340/524
4,258,291 A * 3/1981 Scott et al. ..... 315/156
4,347,499 A * 8/1982 Burkman et al. ..... 340/815.69
4,419,658 A * 12/1983 Jarosz et al. ..... 340/521
4,531,114 A * 7/1985 Topol et al. ..... 340/539.1
4,570,155 A * 2/1986 Skarman et al. ..... 340/531
4,755,792 A * 7/1988 Pezzolo et al. ..... 340/506
4,796,018 A * 1/1989 Nakanishi et al. ..... 340/691.1
5,477,205 A * 12/1995 Burns ..... 340/332
5,815,068 A * 9/1998 Vadseth ..... 340/332
5,889,468 A * 3/1999 Banga ..... 340/628
6,646,545 B2 * 11/2003 Bligh ..... 340/286.05
6,778,071 B2 * 8/2004 Megerle ..... 340/332
6,896,388 B2 * 5/2005 George et al. ..... 362/84
6,897,772 B1 * 5/2005 Scheffler et al. ..... 340/538

* cited by examiner

*Primary Examiner*—John Tweel, Jr.
(74) *Attorney, Agent, or Firm*—Reinhart Boerner Van Deuren P.C.; Thomas J. Roth

(57) ABSTRACT

An integrated lighting control and threat detection system is provided. Once one of the threat detectors determines that a hazardous condition exists, it transmits a threat message to the lighting control system. The lighting control system then operates to turn on illumination within the dwelling to aid in an occupant's safe exiting from the dwelling. The lighting control system operates to illuminate all lights within a dwelling upon detection of a hazardous condition. Alternatively, the lighting control system operates to illuminate preselected paths of lighting as programmed by a user. Still further, coordinated illuminated control may be provided based upon the location of the detected hazardous condition and the fixed and portable lights within a dwelling. Both fixed and adaptive illumination control are provided as is a fail safe illumination of all lights within a dwelling should each of the pre-selected exit paths contain a hazardous condition.

21 Claims, 3 Drawing Sheets

SYSTEM AND METHOD FOR PROVIDING CONTROLLED ILLUMINATION DURING DETECTED HAZARDOUS CONDITIONS

CROSS-REFERENCE TO RELATED PATENT APPLICATIONS

This patent application claims the benefit of U.S. Provisional Patent Application No. 60/535,424, filed Jan. 8, 2004, the teachings and disclosure of which are hereby incorporated in their entireties by reference thereto.

FIELD OF THE INVENTION

The present invention relates generally to hazardous condition detectors, and more particularly to networked hazardous condition detectors that enable controlled illumination during a detected hazardous condition.

BACKGROUND OF THE INVENTION

Recognizing the lifesaving benefits of smoke and other hazardous condition threat detectors, more and more consumers are installing these devices in their homes. Indeed, many municipalities have enacted building ordinances that require that smoke detectors be installed in new construction and in order to sell an existing home. Apartment buildings and other commercial structures typically also include such smoke and other threat detectors. As a result, many consumers and dwellers of such structures are now able to escape the hazardous condition based on the early warning that such a condition exists.

While the lifesaving benefits of such hazardous condition detectors cannot be disputed, they often cause great consumer confusion and panic when they sound their alarm, especially at night. This confusion and panic may occur to its greatest extent when the consumer is awakened from sleep by the sounding of the hazardous condition alarm. This confusion and panic is only exacerbated by the darkness as most consumers do not sleep with many lights, if any, turned on. Knowing that time is short, and often fearing for the safety of their loved ones, these consumers may be injured as they rush around in the darkness in response to the hazardous condition alarm. While most consumers are familiar enough with their dwelling to know where to find safe exits, the darkness and confusion of the situation may cost the consumer valuable time in choosing a safe exit path to reach such exits. Further, while the consumer may be able to turn on lights at their present location, other lights and the switches to illuminate them may be located in dark areas remote from the consumer's present location.

Recognizing that people may not be familiar with exits in hotels, apartment buildings, etc., threat detectors are often centrally wired to emergency lights, typically located along and at the ends of hallways, in stairwells, etc. Unfortunately, such emergency lights often add to the consumer confusion as they are typically sparsely located throughout the hotel, etc., are glaring, and often shine into the consumer's eyes based on the emergency lighting being located typically on walls near the ceiling. Since smoke rises, such location often makes visibility more difficult, similar to turning on a car's high beam lights while driving in fog.

There exists, therefore, a need in the art for a hazardous condition detection system that coordinates dwelling illumination so as to reduce consumer confusion during emergency conditions and to aid their speedy and safe exit from the dwelling.

BRIEF SUMMARY OF THE INVENTION

In view of the above, the system of the present invention provides a new and improved threat detection system that aids in the reduction of consumer confusion and safe exit from a dwelling in which a threat has been detected. More particularly, the present invention provides a new and improved threat detection system that communicates with a lighting control system to provide illumination of the dwelling during the detected threat condition. Still more particularly, the present invention provides new and improved threat detection system that interfaces with a lighting control system to provide coordinated lighting of the dwelling during the detected threat condition so as to aid in the safe escape from the dwelling.

It is a feature of the present invention that the threat detectors include communication circuitry to allow them to communicate with a central lighting system. Preferably, this communication circuitry allows wireless communication with the central lighting system, although both wired and networked communications may also be provided. It is a further feature of the present invention that the illumination control system, upon receiving a threat detected signal, operates to turn on the lights within the dwelling to aid the consumer in exiting the building safely. Alternatively, it is a feature of the present invention that the illumination system provides different paths of light depending upon where the threat condition has been detected based upon knowledge of the location of the threat detectors, the location of the lights within the dwelling, and the location of the exits. It is a further feature of the present invention that such emergency exit paths may be programmed by a consumer or technician. The lighting control system may then determine which of the pre-selected series of lights to illuminate to provide the quickest route to safety from the dwelling.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
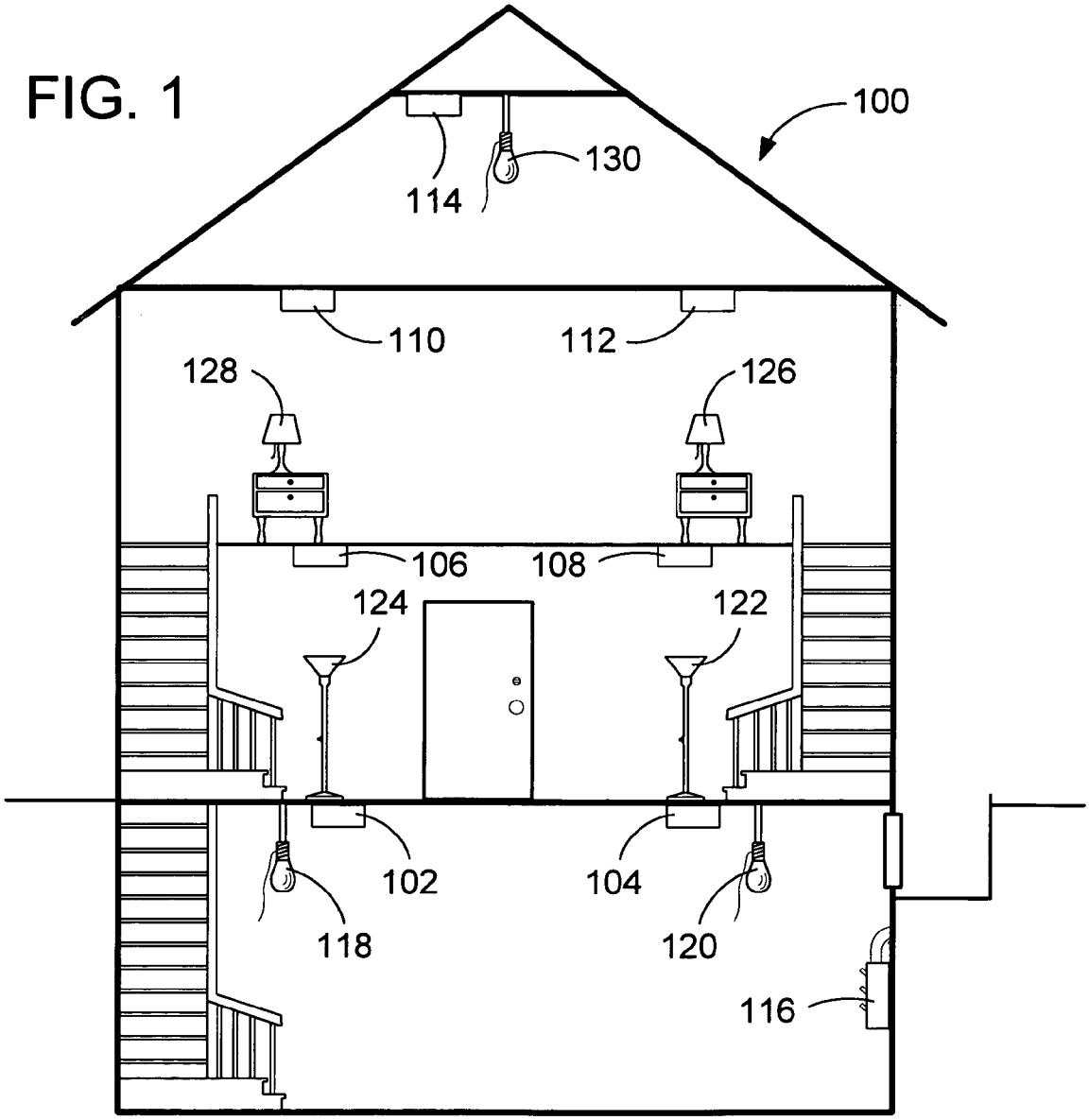
FIG. 1 is a simplified illustration of a typical dwelling in which the system of the present invention finds particular applicability.

While the system of the present invention may be utilized in various commercial and residential structures, the following description will utilize the simplified dwelling 100 illustrated in FIG. 1 to explain the principle of operation and various features enabled by the present invention. However, it should be noted that the invention finds equal applicability in commercial structures, apartment buildings, hotels, etc., wherein it is desired to lessen consumer confusion and increase the probability of safe exit from the building in which a threat, such as a fire, has been detected.

Utilizing this simplified dwelling structure 100 of FIG. 1, it can be seen that the system of the present invention utilizes a number of threat detectors 102-114 located within the dwelling. While the system of the present invention provides enhanced functionality when a plurality of threat detectors 102-114 are utilized throughout the dwelling 100, many of the advantages of the present invention may also be realized when only a single threat detector is utilized as well. As such, the number of threat detectors installed in a dwelling are not limiting to the scope of the present invention.

While the number of threat detectors are not critical in one embodiment of the present invention, the threat detectors do need to include communications capability to allow them to transmit a threat detected signal to a lighting control system, for example the central lighting control system 116 illustrated in FIG. 1. Preferably, such communications includes wireless receiver and/or transmit circuitry in the detector. However, the system of the present invention also allows for wired communication between the detectors 102-114 and the lighting control system 116, or via a communications BUS to which the detectors 102-114 and the lighting control system 116 are attached, as will be discussed more fully below. Through the provision of such communications, the system of the present invention is particularly enabled.

Specifically, transmission of information from the detectors 102-114 to the lighting system 116 may be facilitated by a wired network connecting each of the detectors 102, 104, 106, 108, 110, 112, 114 to the central lighting control system 116. Other wired network structures may also be utilized, including the provision of a system BUS to which each of the detectors, or a combination thereof, and the central lighting system connect. As is well-known in the art, information communicated on the system BUS preferably includes address information identifying the source and/or destination of the information transmitted thereon. Such individual addressing is not typically required in the wired network whereby each individual detector is separately wired to the lighting control system. Various other wired infrastructures could be utilized with the system of the present invention, and are considered within the scope thereof.

With the increasing use, sophistication, reliability, data rates, and security of wireless communication protocols, a preferred embodiment of the present invention utilizes wireless communications between the detectors 102-114 and the central lighting system 116 to communicate the system threat information and control signals therebetween. However, it is recognized that not all of the detectors that may be purchased by a consumer may include such wireless communications capability. Therefore, a preferred embodiment of the lighting control system 116 of the present invention includes the capability to communicate both wirelessly and through a wireless connection.

For the wireless communication, various wireless communication protocols and standards may be implemented depending upon the particular environment in which the system is to be installed. That is, while the Bluetooth wireless standard may be utilized in a very small environment, its range limitations make it unsuitable for larger or typical home environments. However, there are numerous other wireless protocols that can be utilized to provide the wireless connectivity between the central lighting system and the detectors. These other wireless protocols include, but are not limited to, the 802.11 or 802.15 family of standards. While proprietary wireless protocols may also be utilized, the use of a standard wireless protocol ensures interoperability with detectors manufactured by different manufacturers.

As illustrated in FIG. 1, central lighting control system 116 controls a plurality of lights 118-130 located throughout the structure 100. These lights include both stationary built-in lights 118, 120, 130 as well as lights 122-128 which may be placed in various locations by the consumer. These portable lights 122-128 are preferably plugged into a controlled outlet whereby the lighting control system 116 may exercise some measure of control over the energization of the outlet to thereby control the illumination provided by the light. If, however, the consumer utilizes a lamp that includes its own control switch, the central illumination control system of the present invention may not be able to turn this light on if the consumer has switched off its internal control switch.

The location of the stationary, built-in lights 118, 120, 130 is fixed within the structure 100, and therefore may be programmed into the central lighting control system's memory at the time of installation. However, for the portable lights122-128, the consumer will need to reprogram the location of the lights as they are moved within the dwelling in order for the central lighting control system to know the location of these lights. Alternatively, as will be discussed more fully below, the central lighting control system may simply energize each of its controllable outlets into which such portable lights may be installed.

In one embodiment of the present invention, the central lighting control system operates to illuminate all the lights 118-130 within a dwelling 100 upon the receipt of a threat detected signal from one of the detectors. In this way, if the consumer is awakened during the night by the threat detector alarm, the lights 118-130 within the dwelling will be turned on so as to aid the consumer in safely exiting the dwelling. With the illumination of the dwelling turned on, the consumer's level of stress may be lessened slightly as compared to the same situation without the illumination. In other words, in this embodiment of the present invention, all the lights 118-130 within a dwelling which may be controlled by the central lighting control system will be illuminated when any one or combination of threat detectors transmit a threat detected signal.

In an alternate embodiment of the present invention, the central lighting control system 116 of the present invention selectively illuminates lights within the dwelling when at least one of the threat detectors has detected a hazardous condition. In this embodiment of the present invention, the selected illumination may be preprogrammed by the consumer or installer to illuminate certain lights within the dwelling. For example, the consumer may choose to illuminate the entire upstairs bedroom and hall areas, the stairwells, and only those lights on the first floor that lead to an exit. In this way, a consumer may decide that such selected lighting provides a better lighting strategy than lighting areas of the dwelling that do not lead to exits and that may cause confusion and delay exit times for guests staying in the house who may not be familiar with the location of each of the exits.

Figure 2:
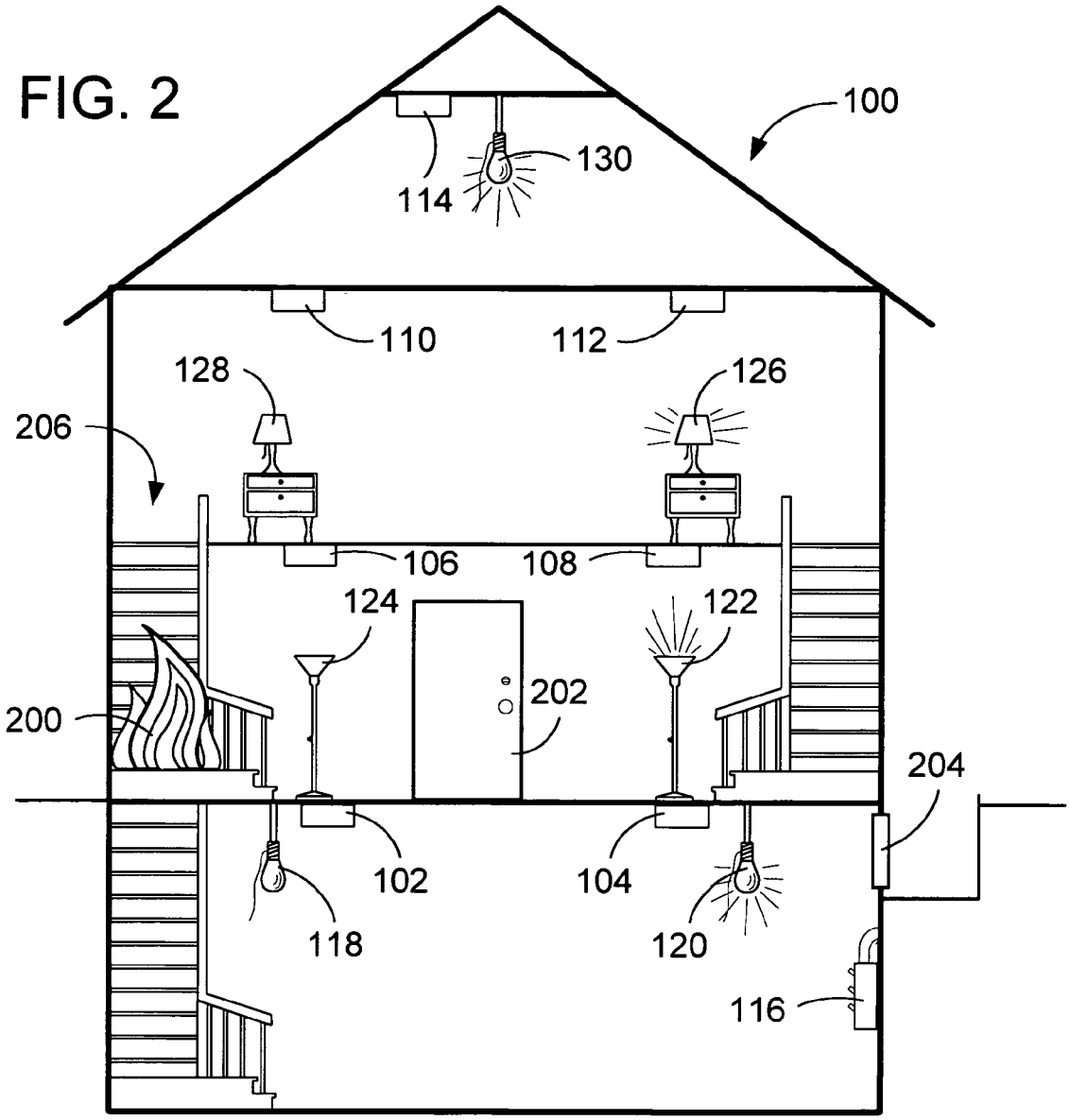
FIG. 2 is the simplified dwelling illustration of FIG. 1 containing a threat at a given location to illustrate an aspect of the present invention whereby a safe path to an exit is illuminated based on a location of a threat condition.

In a still further embodiment of the present invention, the lighting control system may utilize its knowledge of the location of the threat detectors 102-114 to coordinate the control of the lighting throughout the dwelling 100 to direct occupants to safe exit paths away from the detected threat. As illustrated in FIG. 2, a threat is detected near a first staircase 206 illustrated by fire 200. In this case it is likely that threat detector 106 or 110 would detect the condition first and relay the threat detection information to the central lighting control system 116. In response, the central lighting control system 116 will illuminate only those lights 130, 126, 122, 120 that lead away from the detected threat 200 and to a safe exit, such as door 202 or window 204. As shown in FIG. 2, the lights 128, 124 leading to and down staircase 206 are not illuminated as such illumination may well lead an occupant to an area of increased danger.

Figure 3:
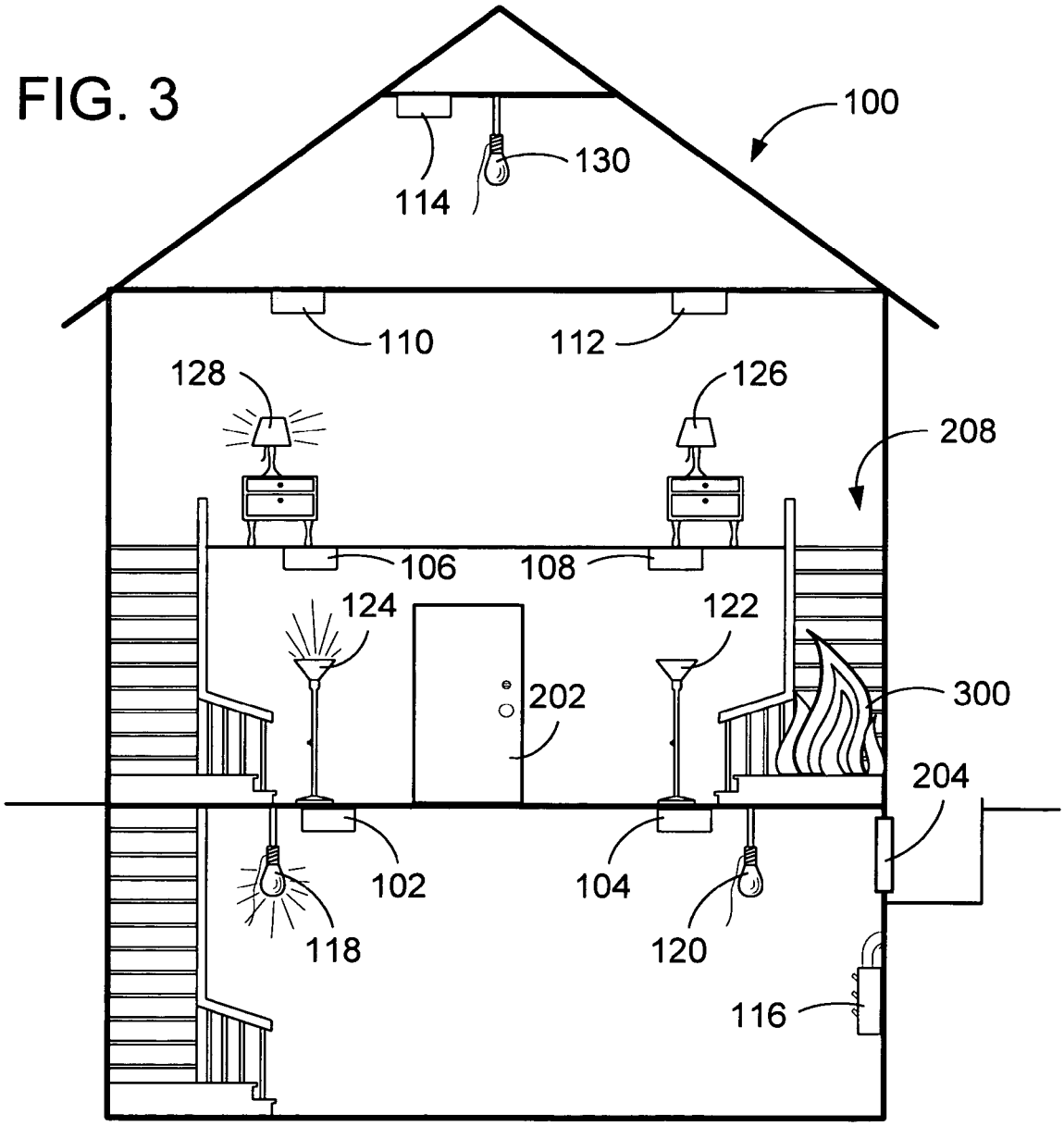
FIG. 3 is the simplified dwelling illustration of FIG. 1 containing a threat at a different location to illustrate an aspect of the present invention whereby a safe path to an exit is illuminated based on a location of a threat condition.

If, however, the threat 300 were first detected in or near the second staircase 208, for example by detector 108 or 112, the central lighting control system 116 would illuminate a different path, e.g., to lead occupants out of the dwelling and a different way to avoid the threat 300. As shown in FIG. 3, the lights 120, 122, and 126 providing illumination to the second staircase 208 is not illuminated, while the lights 128, 124, 118 illuminating the first staircase 206 is illuminated in this situation since the threat is not in this location.

The system of the present invention may utilize the initial detection of the threat to determine the lighting of the dwelling for the duration of the detected threat, or may utilize additional threat detection information to modify the initially illuminated path as the threat spreads. Additionally, if the threat has been detected along each of the predetermined exit paths within the dwelling, the lighting control system of the present invention may operate to illuminate all lights within the dwelling to provide the best chance for the consumer to safely exit the building.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A system for providing controlled illumination within a structure during a detected hazardous condition, comprising:

at least one threat detector;

a lighting control system in communication with the at least one threat detector, the lighting control system being configured to control illumination of a plurality of lights that normally provide illumination within the structure (hereinafter "controlled lights"); and wherein the lighting control system is configured to illuminate less than all of the plurality of controlled lights to provide illumination within the structure upon receipt of a threat detected signal from the threat detector.

2. The system of claim 1, wherein the lighting control system is programmable to turn on predetermined ones of the plurality of controlled lights upon receipt of a threat detected signal from the threat detector.

3. The system of claim 2, wherein the lighting control system is configured to turn on controlled lights located in sleeping quarters and controlled lights leading to an exit and to leave controlled lights in other locations within the structure in their current state.

4. The system of claim 2, further comprising a plurality of threat detectors positioned at different locations within the structure, and wherein the lighting control system is configured to turn on a different combination of controlled lights depending on which one of the threat detectors transmits the threat detected signal first.

5. The system of claim 4, wherein the lighting control system is configured to modify the combination of controlled lights that it turns on when other threat detectors transmit the threat detected signal.

6. A system for providing controlled illumination within a structure during a detected hazardous condition, comprising:

at least one threat detector;

a lighting control system in communication with the at least one threat detector, the lighting control system being configured to control illumination of a plurality of lights that normally provide illumination within the structure; and wherein the lighting control system is configured to illuminate at least one of the plurality of lights to provide illumination within the structure upon receipt of a threat detected signal from the threat detector;

wherein the lighting control system is programmable to turn on predetermined ones of the plurality of lights upon receipt of a threat detected signal from the threat detector;

further comprising a plurality of threat detectors positioned at different locations within the structure;

wherein the lighting control system is configured to turn on a different combination of lights depending on which one of the threat detectors transmits the threat detected signal first; and wherein the lighting control system is configured to turn on all of the plurality of lights when it receives the threat detected signal from a number of threat detectors indicating that exits may be blocked by the detected hazardous condition.

7. The system of claim 1, further comprising a plurality of threat detectors positioned at different locations within the structure, and wherein the lighting control system is configured to turn on predetermined ones of the plurality of controlled lights upon receipt of a threat detected signal from one of the threat detectors based on the location thereof.

8. The system of claim 7, wherein the lighting control system is configured to turn on predetermined ones of the plurality of controlled lights upon receipt of a threat detected signal from one of the threat detectors based on a location of exits from the structure.

9. A lighting control system to control the illumination of lights that normally provide illumination in a structure (hereinafter "controlled lights"), the structure having at least one hazardous condition detector located therein and at least one exit leading therefrom, comprising a lighting system controller configured to turn on less than all of the controlled lights in the structure to provide illumination within the structure upon receipt of a threat detected signal from at least one hazardous condition detector.

10. The system of claim 9, wherein the lighting system controller is programmable to turn on predetermined ones of the plurality of controlled lights upon receipt of a threat detected signal from the hazardous condition detector.

11. The system of claim 10, wherein the lighting system controller is configured to turn on controlled lights located in sleeping quarters and controlled lights leading to an exit and to leave controlled lights in other locations within the structure in their current state.

12. The system of claim 10, wherein the lighting system controller is configured to turn on a different combination of controlled lights depending on which one of the hazardous condition detectors from which the lighting system controller receives the threat detected signal first.

13. The system of claim 12, wherein the lighting system controller is configured to modify the combination of lights that it turns on when the threat detected signal is received from other hazardous condition detectors.

14. The system of claim 9, wherein the lighting control system is configured to turn on predetermined ones of the controlled lights upon receipt of a threat detected signal from one of the hazardous condition detectors based on a location thereof in the structure.

15. The system of claim 14, wherein the lighting system controller is configured to turn on predetermined ones of the controlled lights upon receipt of a threat detected signal from one of the hazardous condition detectors based on a location of exits from the structure.

16. The system of claim 9, wherein the lighting system controller is configured to control illumination of fixed lights in the structure and is user programmable to control illumination of portable lights by controlling energization of electrical outlets into which the portable lights are plugged.

17. A method of providing controlled illumination of lights that normally provide illumination within a structure (hereinafter "controlled lights") during a detected hazardous condition, the structure having at least one hazardous condition detector positioned therein and at least one exit leading therefrom, comprising the steps of:

receiving a threat detected signal transmitted from one of the at least one hazardous condition detector;

turning on less than all of the controlled lights to provide illumination within the structure in response to receiving the threat detected signal.

18. The method of claim 17, wherein the step of turning on less than all of the controlled lights within the structure comprises the step of turning on less than all of the controlled lights including at least one fixed and portable lights.

19. The method of claim 17, wherein the step of turning on less than all of the controlled lights within the structure comprises the step of turning on predetermined ones of the controlled lights leading to the at least one exit.

20. The method of claim 19, wherein the step of turning on predetermined ones of the controlled lights leading to the at least one exit comprises the step of turning on predetermined ones of the controlled lights leading to the at least one exit while leaving controlled lights in a location near the detected hazardous condition in a current state.

21. A method of providing controlled illumination of lights that normally provide illumination within a structure during a detected hazardous condition, the structure having at least one hazardous condition detector positioned therein and at least one exit leading therefrom, comprising the steps of:

receiving a threat detected signal transmitted from one of the at least one hazardous condition detector;

turning on at least one of the lights to provide illumination within the structure;

wherein the step of turning on at least one of the controlled lights within the structure comprises the step of turning on predetermined ones of the controlled lights leading to the at least one exit; and further comprising the steps of receiving the threat detected signal from another of the hazardous condition detectors, and modifying the combination of lights.

* * * * *